United States Patent [19]

Hodges

[11] 4,383,490

[45] May 17, 1983

[54] HOSIERY TOE CLOSING MACHINE

[75] Inventor: Michael J. Hodges, High Wycombe, England

[73] Assignee: Detexomat Machinery Limited, England

[21] Appl. No.: 251,481

[22] Filed: Apr. 6, 1981

[30] Foreign Application Priority Data

Apr. 18, 1980 [GB] United Kingdom ..... 8012830
Mar. 12, 1981 [GB] United Kingdom ..... 8107889

[51] Int. Cl.[3] ..... D05B 21/00
[52] U.S. Cl. ..... 112/121.15
[58] Field of Search ..... 112/121.15, 121.11, 112/121.12, 121.14, 2; 223/43, 112

[56] References Cited

U.S. PATENT DOCUMENTS

| | | | |
|---|---|---|---|
| 3,952,673 | 4/1976 | Fukuyama | 112/121.15 |
| 4,133,276 | 1/1979 | Selui | 112/121.15 |
| 4,188,898 | 2/1980 | Bell, Jr. et al. | 112/121.15 X |
| 4,192,242 | 3/1980 | Haselgrove et al. | 112/121.15 X |
| 4,224,885 | 9/1980 | Takatori | 112/121.15 |
| 4,303,026 | 12/1981 | Ueda | 112/121.15 |

*Primary Examiner*—H. Hampton Hunter
*Attorney, Agent, or Firm*—Wellington M. Manning, Jr.; Luke J. Wilburn, Jr.

[57] ABSTRACT

A toe closer has a plurality of elongated carriers for supporting hose for seaming, a sewing machine to seam their toes and a clamp mechanism for sequentially conveying toe ends past the sewing machine. The carriers move continuously around a closed path traversing a straight section of the path directly opposite the clamp mechanism. The clamp mechanism includes a stationary worktable associated with the sewing machine, and a carriage movable to and fro carrying a movable worktable section and a coacting, intermittently movable clamping belt which is supported in a belt carrier atop the carriage. Drive means move the carriage towards the sewing machine in unison with movement of each carrier along the straight section of the path while the toe end of a hose on each carrier is fed into the clamp mechanism; thereafter the belt is set in motion to slide the toe end from table section to table and across the latter in front of the sewing machine for the latter to produce the required seam.

13 Claims, 6 Drawing Figures

HOSIERY TOE CLOSING MACHINE

Figure 1:
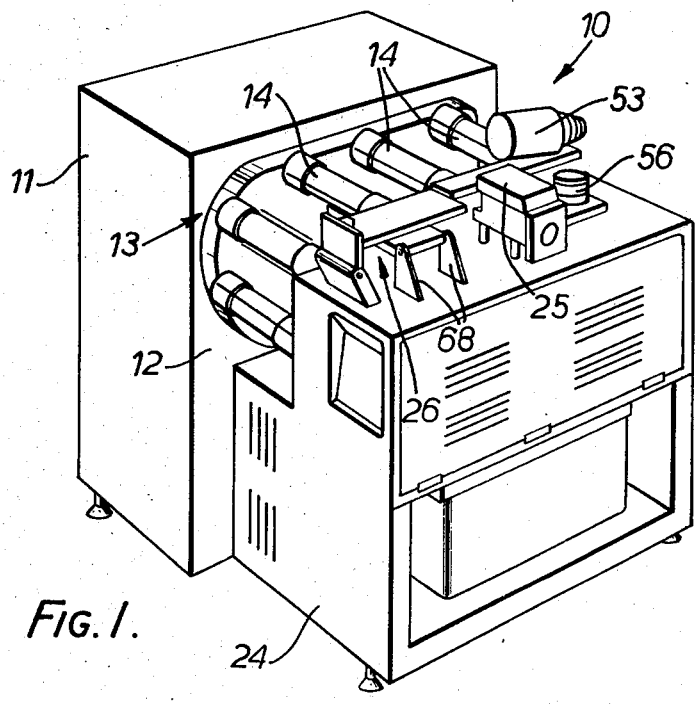

The present invention relates to an improved hosiery toe closing machine.

The machine in question is one which generates a closing seam across one end of a circular hose knit, rather than one which closes the end by a circular knitting technique.

Toe closers which operate by seaming generally utilise the principles disclosed in Detexomat's B.P. Pat. No. 1,039,104. Thus, a hose carrier is provided which either is itself adapted to advance a hose toe end into a clamp or is associated with an advancing mechanism for introducing the toe end into the clamp. Having received the toe end, the clamp executes a movement relative to a seamer (usually a sewing machine): this movement in conjunction with operation of the seamer results in the desired seam. Such a machine is Detexomat's Speedomatic H which is described in B.P. Pat. No. 1,408,912.

In an endeavour to increase production rates, designers have developed machines provided with a plurality of hose carriers mounted on rotary turrets. With such machines, operators can be occupied loading hose onto carriers while the machine simultaneously performs its various operations including seaming. B.P. Pat. No. 1,201,829 discloses one such "turret" machine.

Typically, the rotation of turret machines is discontinuous, i.e. stepwise. The turret halts while each hose carrier is in operative juxtaposition with the seamer, and while seaming is commenced and is in progress. The operator loads carriers with hose when the turret is motionless.

Discontinuous movement of a turret is far from ideal. Noise and vibration can be troublesome unless costly steps are taken, and wear of machine parts and/or loss of adjustment can be substantial practical drawbacks which may lead to undesirable down-time.

Clearly, advantages might be gained if the turret could rotate continuously. Semi-continuous operation is a feature of a machine disclosed in Takatori's B.P. Pat. No. 1,441,188. In the machine disclosed therein, the carriers move smoothly and continuously around a closed path except when they approach the seamer and its clamp. Then, each carrier is arrested and remains stationary as a seaming operation is performed. At completion of seaming, the stationary carrier is nudged into motion around the said path by the next following carrier as the latter moves into juxtaposition with the seamer. This machine therefore does not have carriers continuously moving around the closed path throughout the entire operating cycle of the machine. The machine is complicated by the need for carrier arresting means and potentially suffers from noise and vibration. Owing to its relative complexity, maintenance and down-time may be troublesome.

Another turret machine is the subject of Takatori's B.P. Pat. No. 1,418,141. In the specifically described machine, the turret and its carrier revolve around a closed path in a continuous manner. The seamer—a sewing machine-and its associated hose clamp are mounted on a movable platform which is driven so as to keep pace with an indexing carrier while the hose thereon is being seamed. The platform, and the sewing machine and clamp carried thereby, continually oscillate forwards and backwards between a hose-receiving position and a seamed hose-discharging position. The continual to-and-fro movement is, in our view, highly undesirable because it can significantly upset the proper operation of the sewing machine. Sewing machines conventionally used in toe closers demand a quite copious supply of oil, and oil management can be seriously perturbed if sewing machines designed to be stationary are being moved to and fro continually. Moreover, such sewing machines are complex articles of relatively delicate nature and are not expected to withstand the repetitive jarring, concomitant with the platform motions, at the rates expected if more than 200 dozen pairs of hose are to be seamed in an 8 hour workshift.

The object of our invention is to provide a turret-type toe closer in which the hose carriers move incessantly around a closed path, and in which hose are presented to a stationary seamer without having to be dismounted fully from their continually-moving carriers. The invention also aims to provide such a toe closer which can optionally be fitted with a punch-type seam-straightener able to function properly despite the hose carriers always being in motion.

In order to cope with the continuous motion of the carriers, the preferred toe closer we have developed has a special clamp and drive means therefor. The clamp executes two distinct motions. The first is a translatory movement by which it is arranged that at a critical moment when a hose toe end is admitted to the clamp, there is no relative motion between the carrier bearing that hose and the clamp. The clamp's second motion is responsible for conveying the clamped toe end past the sensor to produce the desired toe-closing seam.

When a punch seam-straightener is fitted, it is coupled with the clamp or the said drive means so as to be displaced in unison with a carrier bearing a seamed hose to be straightened, during the period when the straightener is accomplishing its function.

According to the present invention, there is provided an automatic hosiery toe closing machine, having a plurality of hose carriers movable continuously in unison around an endless path, a seamer at a fixed location adjacent the said path, and a toe end receiving station which the carriers in turn pass, the said station including mechanism operable to take hold of the toe end of the hose mounted on each carrier as the latter is passing the station and to convey the toe end past the seamer for a toe seam of predetermined shape to be formed therein, the mechanism including a gripper to seize a toe end, the gripper being mounted on a carriage having an associated drive means to displace the carriage and gripper such that relative motion between the gripper and carrier is absent when the gripper takes hold of the toe end.

Ordinarily, the gripper is also a clamp which is operable to convey the toe end past the seamer to generate the required toe-closing seam. In some cases, it might be desirable to utilise a separate gripper and clamp, the latter taking over the toe end after the gripper has first taken hold of the toe end.

Further according to the present invention, there is provided an automatic hosiery toe closing machine, comprising a seamer and a cooperating hose toe clamp to take hold of and convey a flattened hose toe end past the seamer for generating a toe closing seam of a predetermined shape, a plurality of hose carriers movable continuously in unison around an endless path such that each carrier in turn moves towards and passes adjacent the clamp and the seamer, the carriers mounting reciprocal toe inserting means for advancing the toe ends of hose mounted on the carriers one by one into the clamp in a flattened, predetermined attitude, the clamp being mounted on a carriage having an associated drive means to displace the carriage and clamp toward the seamer so as to avert relative motion between the clamp and each carrier in turn and thereby preserve the predetermined attitude of each toe end as it is inserted into and taken hold of by the clamp, the clamp thereafter being operable to displace a toe end held thereby relative to the carriage and past the seamer.

The gripper/clamp is advantageously an endless, intermittently-movable clamping belt and a companion clamping surface between which belt and surface toe ends are gripped, the belt being stationary upon the carriage during insertion of the toe end, and the belt being movable thereafter to slide the toe end across the said surface and advance the toe end past the seamer. At a toe end receiving section of the clamp, the belt may be trained around form wheels which conform the belt portion at the toe end receiving station to the predetermined seam shape.

The machine can further include a drive transmission optionally operated by the moving carriage for a punch seam straightener having an operating stroke during which the seam of a toe-closed hose is stretched, the transmission being operable to move the straightener in coincidence with a carrier bearing a seamed hose to be straightened at least during the said operating stroke.

Figure 2:
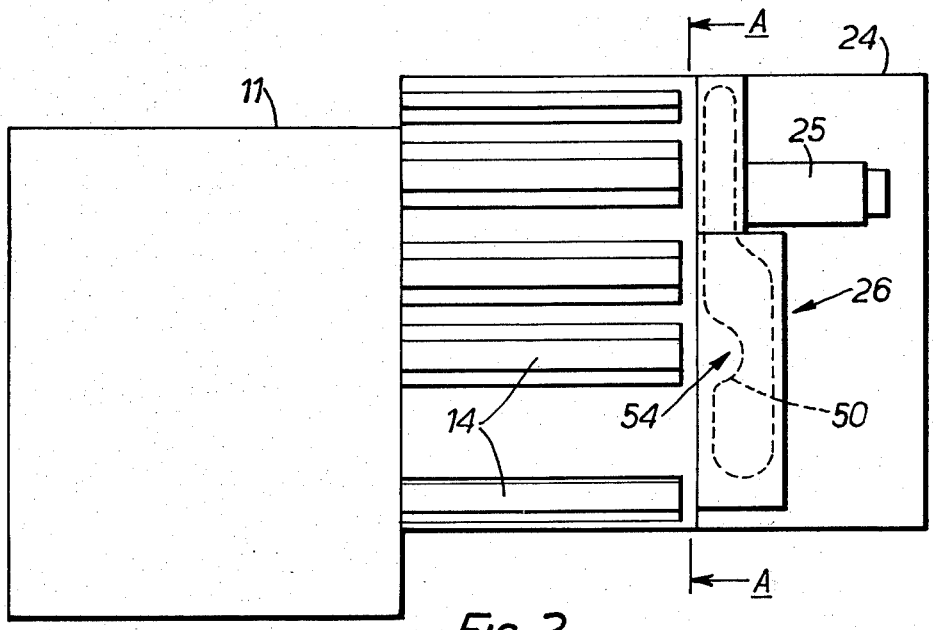
Figure 3:
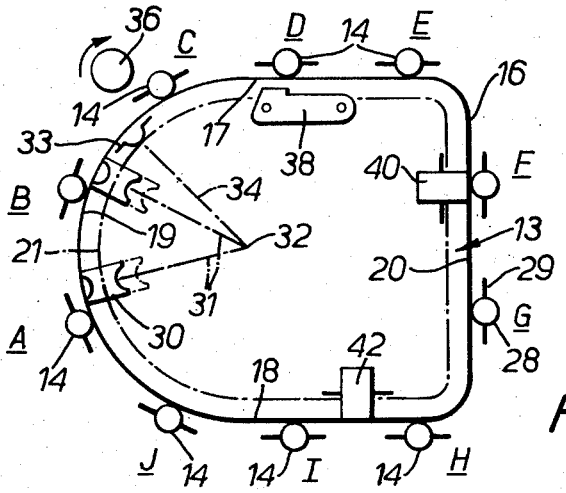
Figure 5:
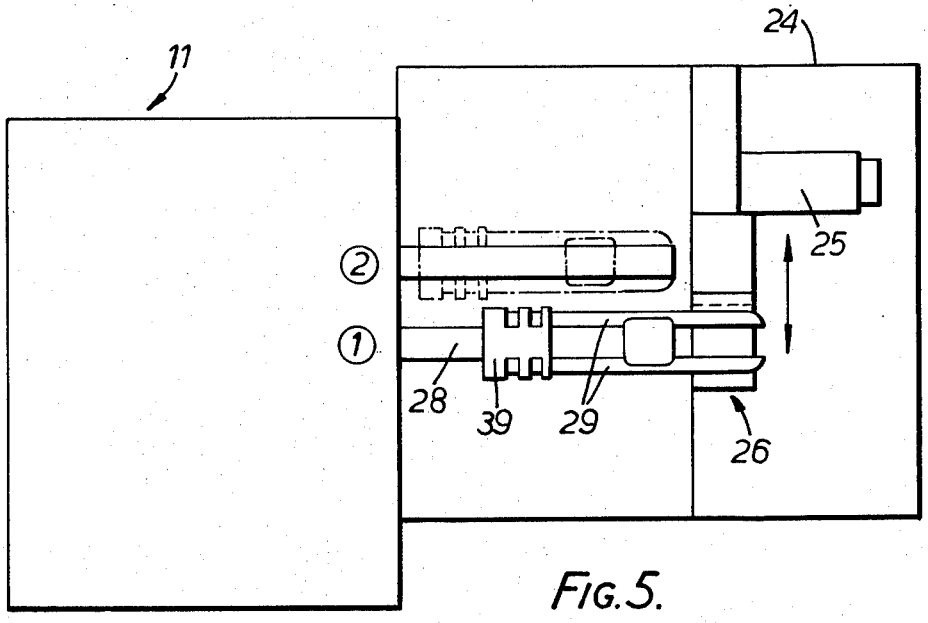
Figure 4:
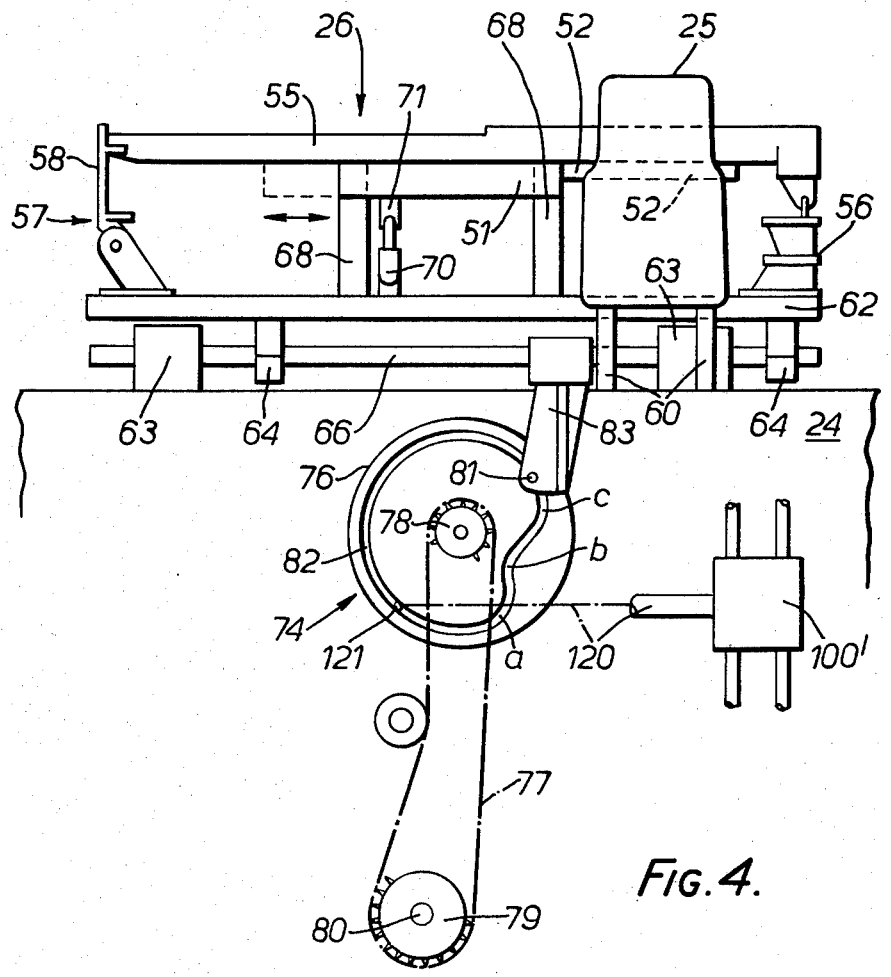
Figure 6:
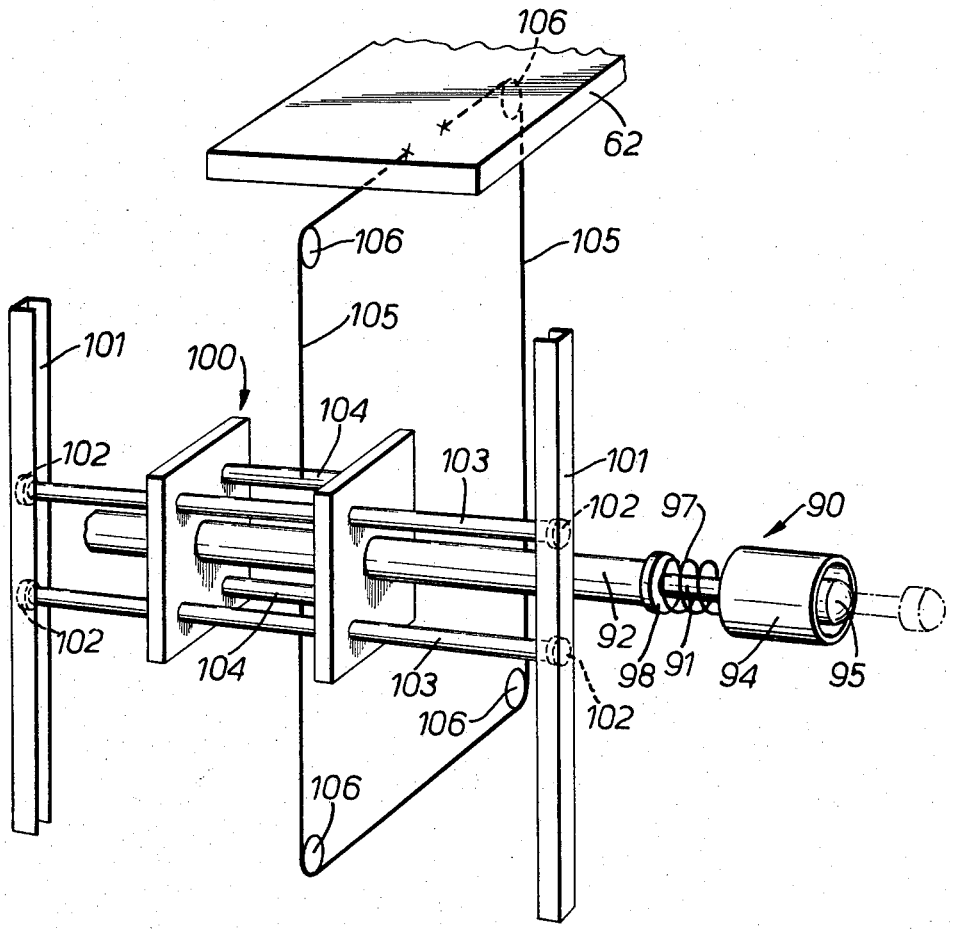

The invention will now be described in more detail by way of example only with reference to the accompanying drawings, in which:

FIG. 1 is a simplified perspective view illustrating the general layout of the preferred toe closer according to the present invention, FIG. 2 is a simplified plan view of the machine shown in FIG. 1, FIG. 3 is an end view of the turret of the machine, as seen generally along the line AA of FIG. 2, FIG. 4 is an illustration of the hose clamp mechanism of the machine associated with the seamer thereof, FIG. 5 is a plan view similar to FIG. 2 illustrative of the operation of means which present a hose toe end into the hose clamp mechanism of the machine, and FIG. 6 is an end view of a portion of the machine, showing mechanism for punch-straightening the seams of hose seamed by the machine.

The general layout of the preferred toe closing machine 10 is illustrated in FIG. 1. A main casing 11 of the machine includes a main drive motor, gear, shaft and chain transmission elements and cam actuators. By means of these, hose carriers are driven, toe end transfer means are actuated and a hose toe clamp mechanism is operated. For simplicity, the motor, transmission elements and actuators are not illustrated. These parts and their arrangement are essentially conventional and follow the general design philosophy of earlier Detexomat toe closers, e.g. the Speedomatic HS and Pantimatic. Accordingly, it is not considered necessary to describe the said parts or to explain their arrangement and operation.

One face 12 of casing 11 comprises a turret 13 featuring a plurality of forwardly-projecting hose carriers 14, ten in all, although there could be fewer or more hose carriers. The hose carriers 14 are equidistant from one another. The turret 13 defines a closed path around which the hose carriers are continuously circulated. Referring to FIG. 3, this path 16 will be seen to have horizontal upper and lower sections 17, 18 merging on the one hand with a semicircular section 19 and on the other hand with a vertical section 20. The carriers 14 are all linked to a drive chain 21 which is driven by the main drive motor, so as to be propelled around the path 16. The operator's position is adjacent the semicircular section 19.

Opposite casing 11 the machine has a second casing 24 which provides support on its upper surface for a sewing machine 25, for example a Union Special Model 39500. Also mounted on casing 24 is a hose gripper or clamp mechanism 26. The function of the clamp mechanism 26 is to take hold of hose toe ends presented serially thereto and to convey them, in turn, past the sewing machine 25. As toe ends are passed across the sewing head of the sewing machine 25, toe closing seams are formed therein in the now-conventional manner.

Before describing the clamp mechanism 26 in detail, the operating cycle of the machine will be explained in general terms. Reference is made primarily to FIG. 3 of the accompanying drawings.

Each of the hose carriers 14 comprises an elongated tube 28 connectible to a source of suction and has an associated pair of diametrically-opposed, longitudinally-movable blades 29. Blades 29 are for presenting hose toe ends into the clamp mechanism 26. The tubes 28 and blades 29 are located inside hose blanks mounted on the hose carriers.

Whenever an empty hose carrier 14 is in the vicinity of position A, the operator loads an open-ended hose blank thereon. In the vicinity of position A, suction is applied to the tube 28. The operator presents a toe end of the blank to the free end of the tube 28, while firmly holding the opposite, welt end of the hose blank. The blank is sucked toe end first into the tube and any twists in the blank are eradicated then or as the hose blank is subsequently wound onto the outside of the carrier 14. As the blank is being sucked into the tube 28, the operator draws the said welt end of the hose blank over the outside of the tube and over the blades 29.

As the carrier moves away from position A, the tube 28 is disconnected from the source of suction. Then, a wind-on wheel 30 is brought automatically into engagement with the carrier 14 and with the portion of the hose blank mounted externally thereon by the operator. Actuation of the wind-on wheel 30 is brought about by the operator when loading the carrier in the vicinity of position A. The operator either displaces a control lever, or preferably interrupts a light beam/photosensor control arrangement when loading, to bring the wind-on wheel 30 into operation. The wind-on wheel 30 is mounted to move to and fro, into and out of engagement as aforesaid, on a radial arm 31. Arm 31 is mounted to swing about the centre 32 of the semicircular section 19 of the path of movement of the carriers. The wind-on wheel is driven by a small electric motor in such a direction as to draw the hose blank fully over the carrier 14. Arm 31 is swung (by means not shown) to maintain the wheel 30 in engagement with the hose blank and carrier 14 during the winding-on operation.

Ordinarily, winding-on takes place between positions adjacent position A and position C. However, it may be desired for the machine 10 to be equipped with a toe positioner and optionally with a heel positioner. Then, it may be more convenient for winding-on to be completed when wheel 30 reaches the vicinity of position B. Upon completion of winding-on, arm 31 and the wind-on wheel are returned to a starting point adjacent position A, ready for winding a hose blank onto the next adjacent carrier 14.

For toe positioning, a shoe 33 is mounted on an arm 34 pivoted at 32 such that the shoe can travel with the carrier 14 and hose blank while toe positioning is in progress. The shoe 33 is mounted on its arm 34 for reciprocal movement longitudinally of the carrier 14. First, the shoe is pressed against the hose toe portion of the blank and is moved towards the free end of the carrier, thus moving the toe end of the blank in this direction. Then, it is moved in the opposite direction moving the said portion away from the end of the carrier. The shoe 34 is moved out of contact with the hose blank when some identifiable feature of the blank passes or reaches a control photocell, not shown. Upon disengagement of the shoe 33 from the hose, the toe portion thereof will be positioned appropriately longitudinally of the carrier for a seam to be generated at a predetermined location across the hose toe end portion.

The toe positioner and its operation is described in detail in our British Pat. No. 1,577,758 and is employed in the Detexomatic Speedomatic HS machine.

Heel positioning may be accomplished generally as described in our co-pending British patent application No. 8000402. The purpose of heel positioning is to ensure that blanks having shaped heels are oriented such that the seams ultimately formed across the toe portions are consistently in some predetermined attitude relative to the heels. Positioning the heel involves rotating the heel, foot and toe end portions of the blank around the carrier 14. To this end, the carrier and blank are brought into engagement with a rotating wheel 36 located anywhere convenient between position A and position D. As shown, wheel 36 may be in the vicinity of position C, and is journalled on a movable arm (not shown) so as to travel with the carrier 14 during its operative phase. The wheel 36 may be stopped, or preferably disengaged from the hose blank and carrier, when an identifying or control mark reaches or passes a control photocell (not shown). The heel is correctly positioned when the wheel 36 is stopped or disengaged from the hose blank.

A suitable, commercial heel positioner is employed in the Detexomat Series 26 Speedomatic HSH machine.

Leaving position C, the carrier with the correctly-located hose blank thereon commences traversing the upper horizontal section 17 of the path 16. Reaching position D, the carrier is in juxtaposition with the clamp mechanism 26. The blades 29 of the carrier are then advanced towards and into the clamp mechanism, while the latter is moved in unison with the carrier as will be described later. For achieving this, a reciprocally movable part 38 of the guide track of the turret is engaged by a blade carriage 39 in the vicinity of position D. A cam-activated linkage controls the movable track part 38, the cam thereof being driven from the aforementioned main drive motor. The cam-activated linkage pushes the track part 38, and with it the blades, towards the clamp mechanism 26 so as to insert the hose toe end portion into the clamp-see position 1, FIG. 5. The clamp then closes on the toe end portion and the blades, the linkage thereafter returning the track part to its initial position. Return of track part 38 withdraws the blades 29 from the clamp, the said toe end being gripped and retained by the clamp. The track part 38 completes its return movement at position 2, FIG. 5.

Advantageously, advancement of the blades 28 towards the clamp mechanism 26 is accompanied by a spreading motion of the blades. This is inter alia to assure that the toe end portion of the blank is in a flat, taut condition as it is gripped by the clamp.

An exemplary arrangement of the movable track part 38 and its cam-activated linkage is disclosed in our co-pending U.K. application No. 8000402.

The said toe end is clamped and then conveyed by clamp mechanism 26 past the seamer 25, thus generating the required seam, as the carrier bearing all but the toe end portion progresses from position D to position E. The seam is complete by the time the carrier reaches position E.

During passage from position E to position F, the seamed toe end dangles from the carrier 14. At position F, a wind-on roller 40 is provided to draw the hose once more fully onto the carrier. Wind-on roller 40 can be substantially identical to the wind-on roller 30 in construction and operation. However, since only a short hose portion has to be drawn onto the carrier, roller 30 may not need to be mounted for travel in unison with the carrier. It may suffice for the carrier 14 merely to brush against the rotating roller 30 as it passes position F, roller 30 being non-displaceably mounted.

Thanks to roller 40, the toe seam is positioned across the free end of the carrier 14. In this position, the seam can be straightened if desired by the optional punch-type seam straightener to be described. Seam straightening occurs as the carrier 14 is progressing from position F to position G.

The final operation carried out by the machine is discharge of the seamed hose. Discharge occurs while the carrier is traversing the lower horizontal section 18 of the closed path with the aid of suction which is established in the tube 28 once more. Suction is applied as the tube travels between positions H and I, and causes the seamed hose to enter the tube toe end first. Entry of the hose into tube 28 is assisted by a non-displaceably mounted, continuously driven roller 42 against which the hose and carrier brush in their movement towards position I.

The seamed hose are conveyed pneumatically from position I to a lay-out facility or to a collection bin.

At position J, no operation is performed, the now unloaded carrier 14 merely progressing towards position A for loading with a fresh hose blank.

It will be appreciated that the operations described above are carried out in sequence on every hose blank loaded onto the turret 13. The machine is capable of seaming up to 600 dozen pairs of hose blanks per 8 hour work shift.

The clamping mechanism according to the invention is now described in more detail with reference to FIGS. 2, 4 and 5 of the drawings.

Mechanism 26 includes an endless clamping belt 50 and a two-part worktable 51, 52. The belt 50 is trained around a plurality of pulleys (not shown) and is intermittently movable around the pulleys by a motor 53, see FIG. 1. Several of the pulleys or form wheels shape a toe-end receiving section 54 of the clamp to the desired seam shape. These form wheels may be displaceable relative to one another for varying the seam shape. Clamping of a hose toe end is by a lower edge of the belt 50 pressing the toe end against the worktable 51, 52. Friction between the toe end of the hose and the belt 50 is greater than the friction between the toe end and the worktable 51, 52. Thus, when the belt is moved by the motor 53, the hose toe end will be slid across the table top past the sewing machine 25 for the seam to be generated thereby, relative motion between toe end and belt 50 being absent. Opening and closing of the clamp formed by the coacting belt 50 and worktable 51, 52 is gained by lowering and raising the worktable section 51 respectively. For servicing, a carrier 55 mounting the belt 50 is pivoted to tilt upwardly upon a support pillar 56, the carrier being secured horizontally in normal use to a second pillar 57 which incorporates a securing latch 58. The carrier 55 can be swung clear of the lower parts 51, 52 of the clamp mechanism 26 around a vertical pivot axis of the pillar 56.

A similar clamping arrangement consisting of an intermittently movable, shaped belt and a coacting worktable, and the way in which the shaped belt is responsible for generating the desired seam outline, is disclosed in and forms the subject of the claims in our British Pat. No. 1,501,869 to which reference is hereby directed. Such a clamping arrangement is used in the Detexomat Pantimatic and Speedomatic HS machines.

Worktable section 52 is always stationary and is associated with the sewing machine 25 which is fixed to the top of cabinet 24 by support posts 60.

The remaining components of the clamp mechanism, viz. parts numbered 50, 51, 53, 55, 56, 57 and 58 are mounted on a reciprocal carriage 62 supported for linear movement by bearing blocks 63 surmounting cabinet 24. The carriage 62 comprises a platform having depending lugs 64 in which at least two slide bars 66 are fast. The slide bars run in the bearing blocks 63. The supports 56, 57 for the belt carrier 55 are secured atop the platform 62 so that they, the carrier and the belt are bodily movable to and fro with the carriage 62.

Worktop section 51 is pivotally mounted between two brackets 68 fastened to the platform 62. A double-acting pneumatic ram 70 connected between the platform 62 and a slotted plate 71 depending from the underside of the worktop section 51 serves to flip the latter up and down about the pivot axis on the brackets 68. The worktop section 51 is drawn down, lowering its edge facing the turret 13, to open the clamp for receiving a hose toe end, and is pushed up about the said pivot axis to clamp the toe end between itself and the belt 50. In its upper position, the worktop section 51 has its top surface coplanar with the top of worktop section 52.

Since the carriers 14 are in continuous motion, it is arranged that the clamp mechanism 26 moves at the same linear speed as a carrier is moving between positions 1 and 2 of FIG. 5. The absence of relative movement is essential during the time a toe end is being presented by the blades 29 into the clamp mechanism 26 and seized thereby upon raising of worktop section 51, otherwise the blades and/or the said mechanism could be damaged. Also, relative motion if allowed would disturb the predetermined positioning of the toe end established by the positioners 33, 36 described hereinbefore.

The clamp mechanism 26 is moved by displacing the carriage 62 from a rest position which is shown in FIG. 4. Drive means 74 for displacing the carriage 62 is so coupled to the turret drive that when the clamp mechanism is in the process of seizing the hose toe end, the said mechanism is moving at the same speed as the carrier 14 holding the hose. The drive means includes a cardiod cam 76 which is rotated as shown in FIG. 4 by a chain 77 looped around a cam sprocket 78 and a drive sprocket 79. The latter is mounted on a shaft 80 extending from casing 24, which houses the said drive means, to casing 11. The shaft 80 is rotationally driven from the turret drive, such that the said drive means 74 is operable in synchronism with the turret drive. A cam follower 81 runs in cam track 82, the follower being mounted on a bracket 83 which is fast with one of the carriage bars 66.

While the follower 81 runs in the main, constant radius portion of the cam track 82, the carriage 62 is stationary in the position shown, table portion 51 abutting table section 52 (i.e. the needle plate of sewing machine 25) while sewing is in progress. Upon encountering the portion of the cam track between a and b, the follower, bracket 83 and carriage 62 are moved rapidly towards the left as seen in FIG. 4, thus moving table section 51 away from the sewing machine. As the follower approaches b, the carriage slows and momentarily pauses, and then commences moving towards the sewing machine, to the right in FIG. 4. The cam track portion lying between b and c is responsible for returning the carriage 62 towards the sewing machine at a controlled speed contrived to be equal to the linear speed of the carrier 14 during presentation of the toe end to the clamp mechanism.

The turret track section 38 mentioned hereinbefore is driven in timed relation with the main turret drive end with the carriage drive means 74.

In operation, movement of the blades 29 towards the clamp mechanism 26 commences at position 1, FIG. 5, while the carriage 62 is accelerating to the left, control means for the ram 70—not shown—holding the worktable section 51 in its lowered position. When the blades are fully advanced, carrying the toe end into the clamp mechanism, the carriage 62, clamp mechanism 26 and carrier 14 are moving in unison. At this time, the ram 70 is actuated to raise table section 51 to nip both the toe end and the blades 29 between itself and the belt 50. While the carrier 14 approaches position 2, the means for displacing turret track section 38 operate to retract the blades from the nip between the belt and table section 51. The drive means 74 continues to keep the carriage 62 moving in unison with the carrier 14 until the blades 29 have been fully retracted from between the belt 50 and table section 51, leaving the toe end gripped therebetween. The carriage then slows down and stops with table sections 51, 52 contiguous or touching. By now, the follower 81 is in the constant radius portion of the cam track 82. Controllers, for instance limit switches actuated by the moving carriage 62, then cause motor 53 to drive the belt 50. The moving belt conveys the hose toe end from now stationary table section 51 to table section 52 and across the latter past the sewing machine 25, the latter being activated just as the toe end approaches it. As the hose toe end leaves the sewing machine 25, the drive means 74 commences driving carriage 62 leafwardly, the cam follower 81 running in cam track portion a–b. The clamp mechanism 26 is then positioned ready for receiving a hose toe end from the next following hose carrier, when its operation as described above will be repeated. The belt drive motor 53 and the sewing machine 25 are switched off as the toe end clears the latter, for instance under the control of limit switches activated e.g. by the carriage or by drive means 74.

In the preferred embodiment, the belt 50 serves two functions. Thus, it coacts with the table section 51 in taking hold of the toe end from the blades 29 and also feeds the toe end past the sewing machine. If desired, a separate gripper and movable clamp could be substituted each to perform a respective one of the two functions.

The toe advancing means could take other forms than the reciprocal blades 29 of the preferred embodiment. One known advancing means which could be employed comprise two fingers mounted independently of the travelling carriers. The fingers are adapted to take hold of a toe end from a carrier, and are arranged to execute an advancing excursion into the clamp mechanism. After carrying the toe end into the said mechanism, the fingers slip from the toe end and return for collecting the next toe end to be seamed.

FIG. 6 shows an end view of parts of the machine in perspective, as seen from adjacent the vertical section 20 of the path 16. A punch seam straightener 90 and a drive therefor are illustrated, the drive being responsive to movement of the carriage 62. The drive operates to displace the seam straightener in unison with a carrier 14 moving between F and G, FIG. 3, while the straightener is performing its operative strokes.

The seam straightener is carried by a movable piston rod 91 of a pneumatic cylinder and piston device 92. Straightener 90 comprises a sleeve or collar 94 which is axially movable on the piston rod 91. Rod 91 terminates in an enlarged head 95 of smooth, domed contour. The collar 94 has a bore large enough for the head 95 to nest therein, the bore being tapered and diminishing in diameter inwardly away from the head. A spring 97 acts between a fixed abutment 98 and the collar 94 to bias the latter to the right, i.e. towards the turret 13. The mouth of the bore in collar 94 is large enough to fit over the free ends of the carrier suction tubes, and the head 95 is small enough to enter the tubes.

To straighten a hose seam, after the latter has been disposed across the free end of the carrier tube 28 by wind-on wheel 40, the seam straightener 90 is brought into coaxial alignment with the said tube. The pneumatic device 92 is then activated to advance the piston rod 91 rightwards. The collar then slips over the end of the tube 28 and, thanks to its tapered bore, is responsible for firmly nipping the hose adjacent its toe end against the tube end. Continued movement of the piston rod advances the head 95 down the inside of the tube 28, the spring 97 being compressed as the head moves relative to the collar 94. As the head 95 advances, the seamed toe engaged thereby is forced into the tube and the seam straightened. Straightening results from stretching the toe relative to the adjacent hose portion which is clamped between the tube end and the collar.

After stretching the seam, the straightener 90 is retracted from engagement with the carrier tube 28 by appropriate operation of the pneumatic device 92.

Since the carriers 14 are continuously moving, the seam straightener 90 has to move in unison with each carrier during its operative phase when it is engaging the carrier.

The seam straightener is mounted rigidly on a carrier frame 100. Carrier frame 100 is vertically reciprocal between parallel channel guides 101 which receive rollers 102 on the ends of spindles 103 fast with the frame 100. Anchored to two bars 104 forming part of the frame 100 is a drive chain 105 which is trained around a plurality of sprockets 106. The chain is fastened to the carriage 62 of the clamp mechanism 26.

It will be appreciated that when the carriage 62 is moved towards the sewing machine 25, in the course of which it moves at a linear speed equal to that of a carrier passing position D, the carrier frame 100 will be moved vertically downwardly at the same speed. The seam straightener 90 is therefore displaced downwardly in unison with a carrier 14 moving in the vicinity of F to G. Valving for controlling the operation of the pneumatic device 92 is operated in any convenient way, to extend and then retract the straightener 90, while the latter is moving in alignment with the carrier 14. After retraction of the straightener, the frame 100 pauses while carriage 62 is at rest and then is moved upwardly as the carriage 62 is moved to the left (FIG. 4). The straightener repeats its operation on the hose mounted on the next succeeding carrier 14 when moving in unison therewith, this occurring while the carriage 62 is moving in the direction of the sewing machine (to the right in FIG. 4).

The straightener drive just described is derived from the carriage 62 by means of the chain and sprockets 105 and 106. An alternative drive arrangement which is simpler is illustrated in FIG. 4. In this arrangement, the cam 76 is coupled to the vertically-guided straightener frame 100' by a drive transmitting lever 200. This lever is fast with the frame 100' and, remote therefrom, terminates in a follower 121 running in the cam track 82. It will be appreciated that as the follower 121 rides along track section a–b, it is displaced upwardly. The lever 120 and frame 100' accordingly ascend. When riding along track section b–c, the follower 121 descends, thus displacing the frame 100' via the lever 120 downwardly in unison with a carrier 14, the latter bearing hose needing its seam straightening and descending between positions F and G.

I claim:

1. An automatic hosiery toe closing machine, having a plurality of hose carriers movable continuously in unison around an endless path, a seamer at a fixed location adjacent the said path, and a toe end receiving station which the carriers in turn pass, mechanism at said station operable (i) to take hold of the toe end of hose mounted on each carrier as the latter is passing the station and (ii) to convey the toe end past said seamer for a toe seam of predetermined shape to be formed therein, said mechanism including a gripper to seize a toe end, a carriage mounting said gripper and an associated drive means to displace the carriage and gripper avoiding relative motion between the gripper and carrier when said gripper seizes the toe end.

2. A machine according to claim 1, wherein said gripper is a clamp into which a toe end is inserted and which, having seized the toe end, is operable to displace the toe end relative to the carriage and seamer for the generation of the desired toe seam.

3. A machine according to claim 2, wherein said clamp is an endless, intermittently-movable clamping belt and a companion clamping surface for gripping toe ends therebetween, said belt being movable after insertion of a toe end into said clamp to slide the toe end across said surface and advance the toe end past the seamer.

4. A machine according to claim 3, wherein at a toe end receiving section of the clamp the belt is trained around form wheels which conform the belt portion at the toe end receiving station to the predetermined seam shape.

5. A machine according to claim 1, wherein each hose carrier has a reciprocal toe inserter for projecting the toe end of a hose thereon into said gripper.

6. An automatic hosiery toe closing machine, comprising a seamer, a cooperating hose toe clamp to take hold of and convey a flattened hose toe end past the seamer for generating a toe closing seam of a predetermined shape, a plurality of hose carriers movable continuously in unison around an endless path such that each carrier in turn moves towards and passes adjacent said clamp and said seamer, reciprocal toe inserting means mounted on said carriers for advancing the toe ends of hose thereon one by one into said clamp in a flattened, predetermined attitude, a carriage mounting said clamp and associated drive means operable to displace said carriage and clamp toward said seamer and avert relative motion between said clamp and each carrier in turn, thereby to preserve the predetermined attitude of each toe end as it is inserted into and taken hold of by said clamp, which clamp thereafter is operable to displace the toe end held thereby relative to the carriage and past the seamer.

7. A machine according to claim 6, wherein said clamp is an endless, intermittently-movable clamping belt ends therebetween, said belt being movable after insertion of a toe end into said clamp to slide the toe end across said surface and advance the toe end past the seamer.

8. A machine according to claim 7, including form wheels at a toe end receiving section of the clamp around which said belt is trained to conform the belt portion at the toe end receiving station to the predetermined seam shape.

9. A machine according to claim 6, wherein said toe inserting means comprise a pair of flat blades mounted for longitudinal to and fro motion on each carrier, and each said carrier is an elongated suction everter tube.

10. A machine according to claim 2, wherein said carriage is movable between positions remote from and adjacent said seamer, and said drive means is operable (i) to accelerate said carriage from rest, remove from said seamer towards said seamer to attain the speed necessary to achieve the absence of relative motion and (ii) to cause said carriage to halt adjacent said seamer for said clamp to move the toe end past said seamer.

11. A machine according to claim 1, further including a movable punch seam straightener having an operating stroke during which the seam of a toe-closed hose is stretched, and a transmission operable to move the straightener in coincidence with a carrier bearing a seamed hose to be straightened at least during said operating stroke.

12. A machine according to claim 11, wherein said drive transmission is a drive chain which connects said seam straightener with said carriage for movement in unison therewith.

13. A machine according to claim 11, wherein said carriage drive means is a cardiod cam, and a cam follower is fast with said seam straightener and engages said cam to serve as said drive transmission, whereby movements of said carriage and seam straightener are synchronised with one another and said carriers.

* * * * *

UNITED STATES PATENT AND TRADEMARK OFFICE

CERTIFICATE OF CORRECTION

PATENT NO. : 4,383,490

DATED : May 17, 1983

INVENTOR(S) : Michael J. Hodges

It is certified that error appears in the above-identified patent and that said Letters Patent are hereby corrected as shown below:

Column 11, claim 7, line 18, after "belt", first occurrence, insert--and a companion clamping surface for gripping toe--.

Signed and Sealed this

*Twentieth* Day of *December 1983*

[SEAL]

*Attest:*

GERALD J. MOSSINGHOFF

*Attesting Officer*

*Commissioner of Patents and Trademarks*